United States Patent [19]

Yang

[11] Patent Number: 4,745,886

[45] Date of Patent: May 24, 1988

[54] BACK AND FORTH MOTION TYPE OF THE INTERNAL ENGINE WITH THE SEPARATE GAS CHAMBER AND ITS APPLICATION EQUIPMENT

[76] Inventor: Tai-Her Yang, 5-1 Taipin St., Si-Hu Town, Dzan-Hwa, Taiwan

[21] Appl. No.: 791,461

[22] Filed: Oct. 25, 1985

[51] Int. Cl.[4] ..... F02B 33/10

[52] U.S. Cl. ..... 123/71 R; 123/57 R

[58] Field of Search ..... 123/39, 62, 71 R, 63, 123/57 R, 57 A, 146.5 A

[56] References Cited

U.S. PATENT DOCUMENTS

| | | | |
|---|---|---|---|
| 332,312 | 12/1885 | Wilcox | 123/62 |
| 1,482,686 | 2/1924 | Julson | 123/146.5 A |
| 1,981,610 | 11/1934 | Buckley | 123/71 R |
| 2,051,204 | 8/1936 | Elwell | 123/71 R |
| 2,083,808 | 6/1937 | Andrews | 123/71 R |
| 2,384,422 | 9/1945 | Kinder | 123/71 R |
| 2,838,034 | 6/1958 | Clark | 123/39 |
| 3,557,761 | 1/1971 | Wenzel | 123/71 R |
| 4,205,638 | 6/1980 | Vlacancinch | 123/71 R |
| 4,305,352 | 12/1981 | Oshima et al. | 123/146.5 A |

*Primary Examiner*—Charles J. Myhre
*Assistant Examiner*—David A. Okonsky
*Attorney, Agent, or Firm*—Leonard Bloom

[57] ABSTRACT

An internal combustion engine having an upper cylindrical gas chamber and a lower cylindrical gas chamber. The upper chamber having a bottom portion serving as a compression chamber and the lower chamber serving as the combustion chamber. A cooling jacket is provided between the two chamber to cool the sealing means therebetween. An inter-chamber passageway for direct communication between the bottom portion and lower chamber is provided.

8 Claims, 24 Drawing Sheets

BACK AND FORTH MOTION TYPE OF THE INTERNAL ENGINE WITH THE SEPARATE GAS CHAMBER AND ITS APPLICATION EQUIPMENT

BACKGROUND OF THE INVENTION

This is an example of the special construction for the back and forth motion type of the internal combustion engine with the separate gas chamber in the various industrial machines. It is also a design example of the various function of the pressure feed gas chamber set for the engine. It can reduce costs and increase engine efficiency.

SUMMARY OF THE INVENTION

The applicant has improved the various compatible application examples to some machine structure types and its application structures based on the design principle of the separate gas chamber defined in the original case. The various types have their individual suitable situation. It comprises mainly the equipment of the pressure input gas chamber on the upper section and its relative auxiliary intake and exhaust structure for the supplement of the uncompletional parts defined in the original case and furthermore to show the fluid pump function for the air, water or oil using the space formed by the piston back side of the pressure input gas chamber as well as the electrical generating function by means of the direct drive.

BRIEF DESCRIPTION OF THE DRAWINGS

FIG. 1-1 shows the sectional diagram II of the application example of the back and forth motion type of the internal combustion engine with the separate gas chamber.

FIG. 2-1 shpws the diagram of the intake travel.

FIG. 2-2 shows the diagram of the pressure and ignition travel.

FIG. 2-3 shows the diagram of the explosion and move force travel.

FIG. 2-4 shows the diagram of the exhaust travel.

FIG. 2-5 shows the diagram of a application example of the combustible gas trasport using the upper and lower hollow piston rod with the transport holes.

FIG. 2-6 shows the diagram of a application example of the separate chamber engine with the upper and lower double pressure input chamber and the outer pressure reservoir.

FIG. 2-7 shows the sectional diagram of FIG. 2-6

FIG. 3 shows the diagram of an application example of the gas pump using the upper piston.

FIG. 4 shows the diagram of an application example of the drive turbine pressurizing equipment using the upper piston drive pump.

FIG. 4-1 shows the diagram of an application example of the separate gas chamber engine with the gas input pressurizing three sectional piston.

FIG. 4-2 shows the sectional diagram of FIG. 4-1.

FIG. 5 shows the diagram od an application example of the liquid pump using the upper piston.

FIG. 6 shows the diagram of an application example of the lineal electric generation engine with the outer cycle generator winding coupled with the upper piston.

FIG. 6-1 shows the diagram of an application example of the lineal electric generation engine with the outer cycle magnetic pole coupled with the upper piston.

FIG. 7 shows the diagram of an application example of the lineal electric generation equipment coupled with the gas chamber engine with the pump drive function.

FIG. 9-1 shows the sectional diagram of FIG. 9.

FIG. 10-1 shows the sectional diagrams of FIG. 10.

FIG. 11-1 shows the sectional diagram of FIG. 11.

DETAILED DESCRIPTION OF THE INVENTION

Figure 1:
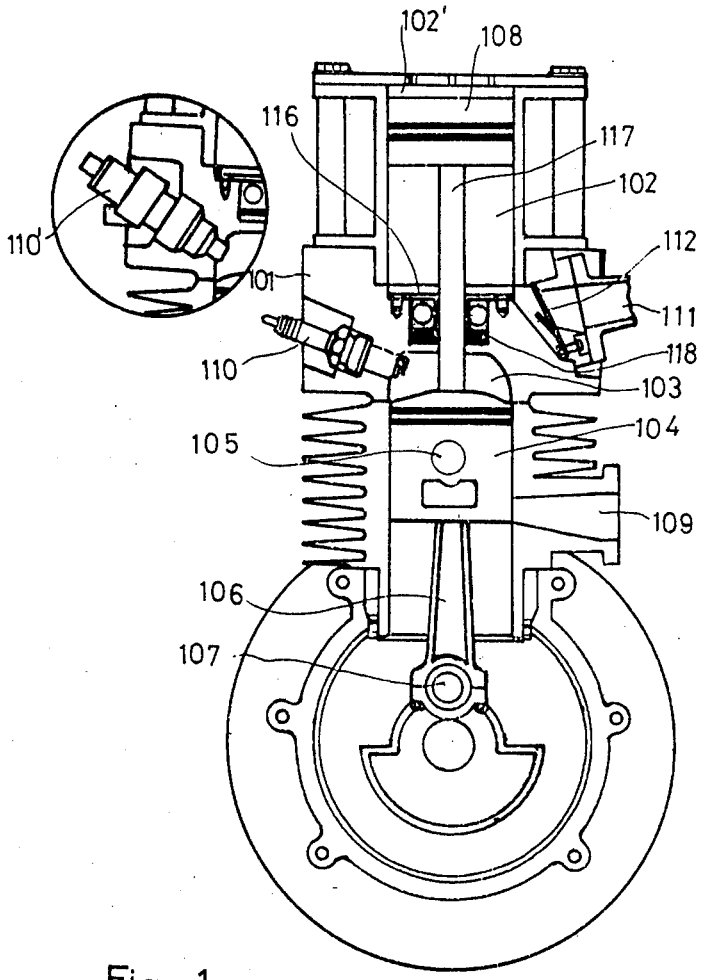
FIG. 1 shows the sectinal diagram I of the application example of the back and forth motion type of the internal combustion engine with the separate gas chamber.
Figure 1:
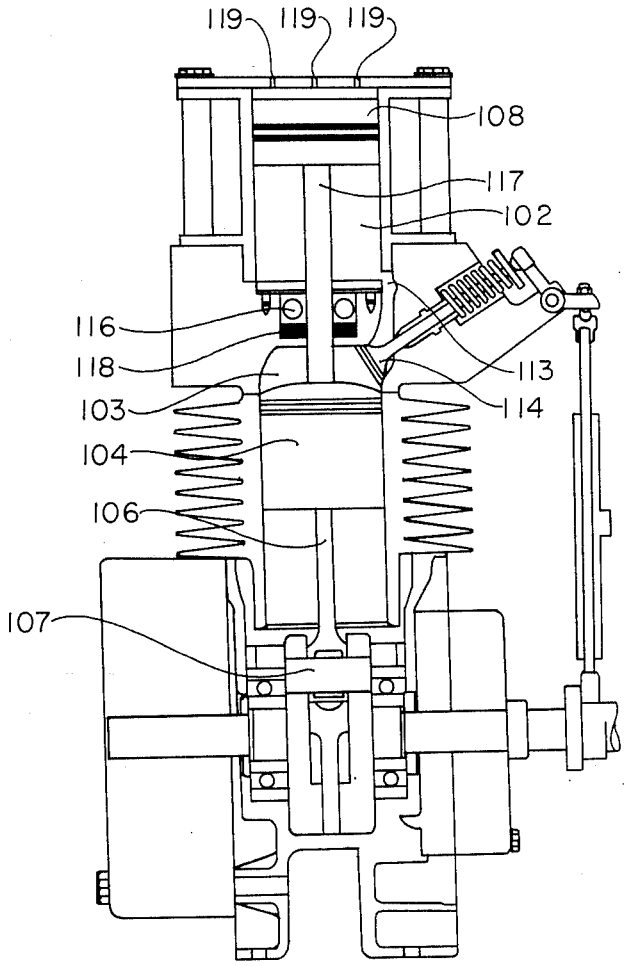

The applicant has explained the constructive type. Now he does improve the structure type for the equipping the pressure input gas chamber on the upper side of the explosion and the exhaust gas chamber. The advantage of this type is shortening of the crank length and its stationary. It is the improvement of the original structure. FIGS. 1 and 1-1 are the example of its application. We describe them in detail as follows:

In FIGS. 1 and 1-1, a cylinder block 101 has each cylinder gas chamber 102, 103 on the upper and lower sides. The lower cylinder block is equipped with a lower piston 104 which can endure the explosion pressure and with a bias link pin 105 which can move bias crank axle 107 and cause rotative output.

The upper piston 108 locates between the upper cylindrical gas chamber 102 and the lower piston. Using a piston link 117, the both parts connect each other. The phase relation of both parts is synchronized, including the reach to the upper stop point and to the lower stop point at the same time. In FIG. 1, the exhaust opening 109 locates at hte lower stop point in the lower gas chamber.

The ignition plug 110 is equipped in the near of the top of the lower gas chamber. When we use jet oil inlet 121, only fresh airs can come into the pressure input gas chamber.

The intake opening 111 is equipped in the near of the lower stop point in the upper gas chamber 102. It is equipped with a single direction valve 112.

The end of the gas transport opening of the combustion gas transport way or inter-chamber passageway 113 is equipped in the near of the lower stop point in the upper gas chamber. Its another end is equipped at the top point of the lower gas chamber and is located diagonally with the exhaust opening.

The intake piece or lower chamber intake valve 114 is used for the control of the opening and closing of the combustion gas transport way. This intake piece is controlled by the synchron mechanism, such as the bias wheel on the flange axle, synchron toothed belt and synchron bias gear. When the lower piston 104 returns from the near of the lower stop point to the upper stop point. It is opened and let the combustion gas come into the lower gas chamber 103 used for the combustion chamber.

A gas pump chamber 102*a* is formed among the upper side of the upper piston 108 and the upper section of the upper gas chamber and the back side of the upper piston. Exceting the equipment of a gas opening 119 for the avoidance of the block, it can be also equipped the additional inlet valve and outlet valve to form a pump for the pump using in the water, oil or gas, or for the movement of a pressurizing turbine.

The ignition coil can ignite the combustion gas, when the lower piston 104 has reached the upper stop point. When the engine is running, the combustion gases come into the upper gas chamber 102 through the intake opening 111 and the single direction intake valve 112 due to upward pump of the upper piston 108. When the upper piston 108 pumps downward and the combustion gas is compressed and stirred in the near of the lower stop point, the intake piece 114 is opened, the combustion gas comes into the lower gas chamber 103 through the combustion gas transport way 113 and pushes the exhaust gas through the exhaust opening to the open air. When the lower piston 104 returns to the upper stop point, the ignition coil let the ignition plug 110 ignite and let the fresh combustion gas explode. At this time, the upper piston 108 has the finished gas input and is prepared for the compression.

Cooling opening 116 is used for the pump cooling fluids which can cool the oil seal 118 coupled with the upper and the lower piston link or shaft 117, the outer oil tank, the cooling fan or the liquid pump, the cooling liquid tank and the start motor . . . etc. For its movement process, please refer to FIGS. 2-1, 2-2, 2-3 and 2-4.

Furthermore, the gas intake type from the upper gas chamber into the lower gas chamber with the above said engine structure can be reached by the following method: As defined in FIG. 2-5, the upper piston link and the lower piston hollow link 201 have the hollow pipe, in which a intake opening 202 at the upper end and a exhaust opening 203 at the lower end. The time of the intake starting is decided by the position selection of the lower exhaust opening 203.

As defined in FIGS. 2-6 and 2-7, the body structure is same as the diagram, but two sides of the upper piston 208 form two intake gas chambers separately with the upper gas chamber 204 and the upper section of the upper gas chamber 204'. In which the upper gas chamber 204 is equipped with a single direction intake opening valve and a single direction exhaust opening valve 206 and a gas pump chamber 204' formed by the upper section of the upper gas chamber and the back side of the upper piston is equipped with a single direction intake opening valve 205' and a single direction exhaust opening valve 206'. Two intake opening valves 205 and 205' are connected separately with a carburetor. Two exhaust opening valves are connected separately with a pressure reservoir 207. This pressure reservoir is used for the aceptance of the compressed combustion gas pumped upward and dowmward by the upper piston for the increasement of the gas intake density. The space between the output opening of the pressure reservoir and the combustion chamber is used for the aceptance of the combustion gas controlled synchronously by the steam valve piece. If the feed oil of this engine is changed to the jet feed oil, the fresh air is intaked and compressed and the oil is feeded directly by the jet nozzole.

The advantages of the abovementioned design are as follows:

1. The intake opening is located diagonally with the exhaust opening. Therefore, the elimination of the waste gas is easier and its combustion gas has less than the traditional two travel engine intake and exhaust openings. Thus the combustion efficiency and the engine power are increased.

2. The curved shaft and the piston lubrication system can use the semi-closed dipping type, so that the combustion oil system is separated from the lubrication system. Therefore, it is not need to add the mixture of the lubrication oil and the motor oil to gasoline due to the transport of the combustion gas through the curved shaft tank as the traditional two travel engine. Thus the smog pollution after the combustion can be avoided.

3. It needs less parts and has the simple structure.

4. A pump function is formed by the upper gas chamber and the upper piston. Therefore, it can be used as the fluid pump, when we use the single way intake valve and the exhaust valve. As the application example defined in FIG. 3, it uses a compression air pump and is lacking the transmission system and the independent gas pump cylinder which is needed in the traditional engine drive air compression. Therefore, it can reduce the costs and can increase the efficiency.

Its all application structures are shown as follows: In FIG. 3, No. 301 is the intake valve, 302 is the exhaust valve equipped at the upper side of the upper gas chamber or on the upper cover, 303 is the air filter connected to the front of the intake valve, 304 is the pressure reservoir connected with the exhaust valve, 305 is the pressure reducing valve connected with the pressure reservoir, 306 is the pressure manometer. The above-mentioned parts form a air compressor system for driving the air drive apparatus.

Figures 1, 2:
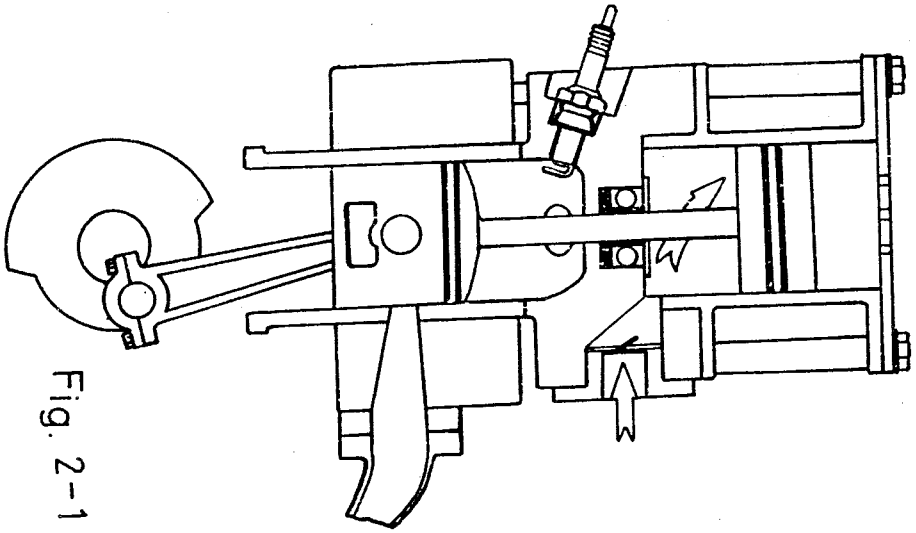
Figure 2:
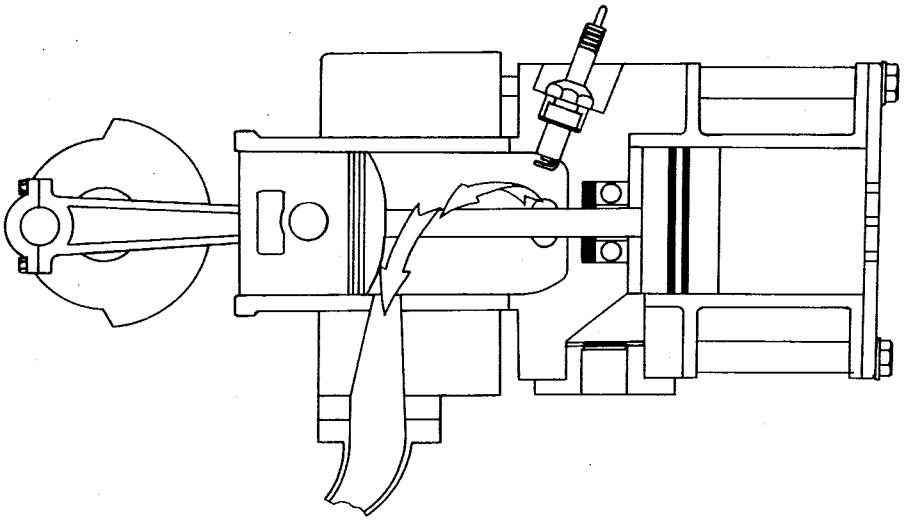
Figures 2, 3:
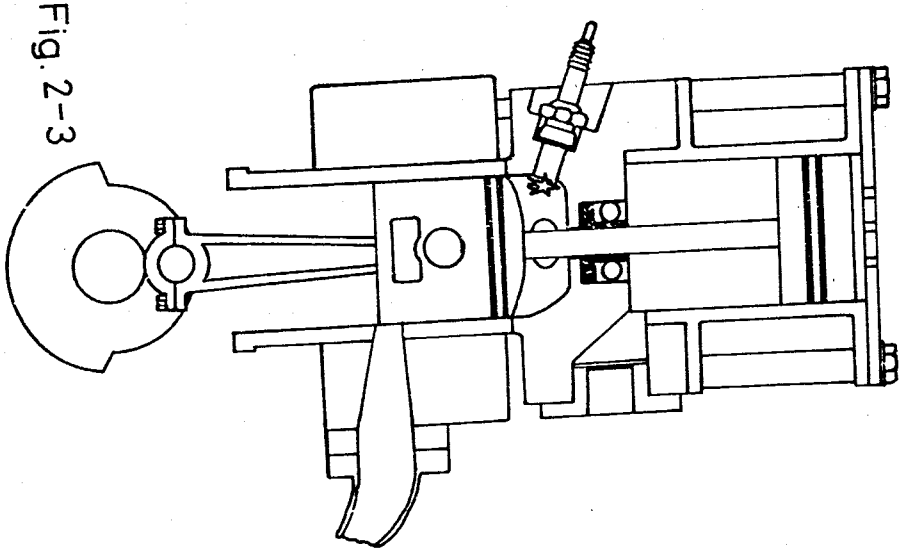
Figures 2, 3, 4:
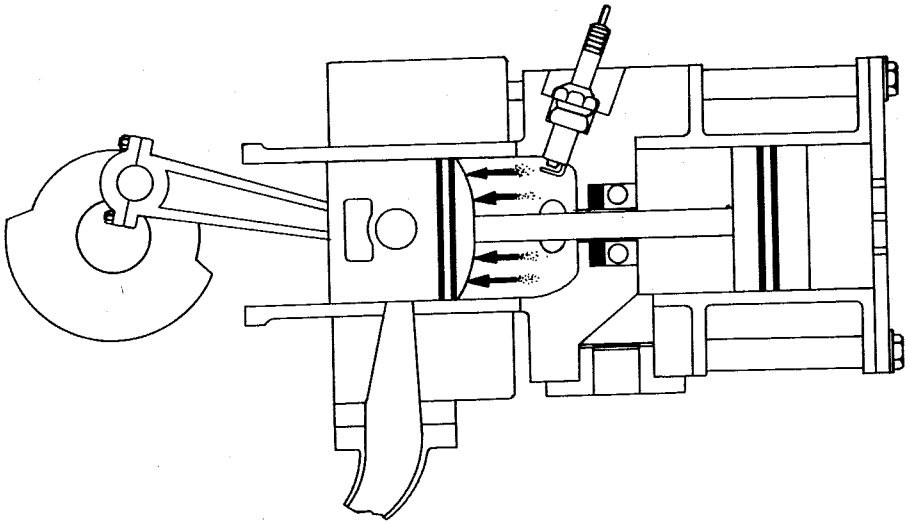

Its application can be made by the direct drive of the turbine pressurizer using the above said air pressure, as defined in FIG. 4. In FIG. 4, 401 is a air drive turbine equipment, its air pump outlet 402 is coupled with the intake opening 403. The gas pump inlet 404 is connected with the carburetor. The upper section of the upper gas chamber and each side of the upper piston 406 form a gas pump chamber 405, the pump inlet 407 is equipped with the single way valve 408, the pump outlet is connected with the drive inlet 409 of the turbine equipment and its output goes through the outlet 410, so that the intake pressure increases during the running of the engine. Its function is same as the various used turbine pressurizing equipment. If we use the fluid to drive the turbine pressurizing equipment, the same function will be shown.

The intake pressurizing of the above engine can be described in FIGS. 4-1 and 4-2. Using the third piston 421 over the upper piston and the third cylinder 422 equipped at the same time, the gas pump function is formed by the above formed double gas chambers 423 and 424. Adding the original upper piston 425 and the upper section of the upper gas chamber 426 to them, a gas pump is formed. The letter can input the pressurizing combustion gas into the pressure reservoir 427. Each intake opening of the abovementioned pump chamber is equipped separately with the single way valves 428, 429 and 430 for the input of the combustion gas come from the carburetor. Each outlet is equipped also separately with the single way valve 431, 432 and 433 for the connection to the pressure reservoir 427. There is a single way valve 434 between the pressure reservoir and the main pressurizing gas chamber 435 compressed twice. A intake door which can be adjusted is located between the main pressurizing gas chamber 435 and the combustion chamber. It can control the intake time. During the driving, the air should be pre-compressed in order to increasement of the intake quantity and the output power. Excepting the intake pre-compression, the further process is same as which described in FIG. 1. In the embodiment shown in FIG. 4-2, either a spark plug 410 or a jet oil inlet 441 can be used.

Figures 2, 3, 4, 5:
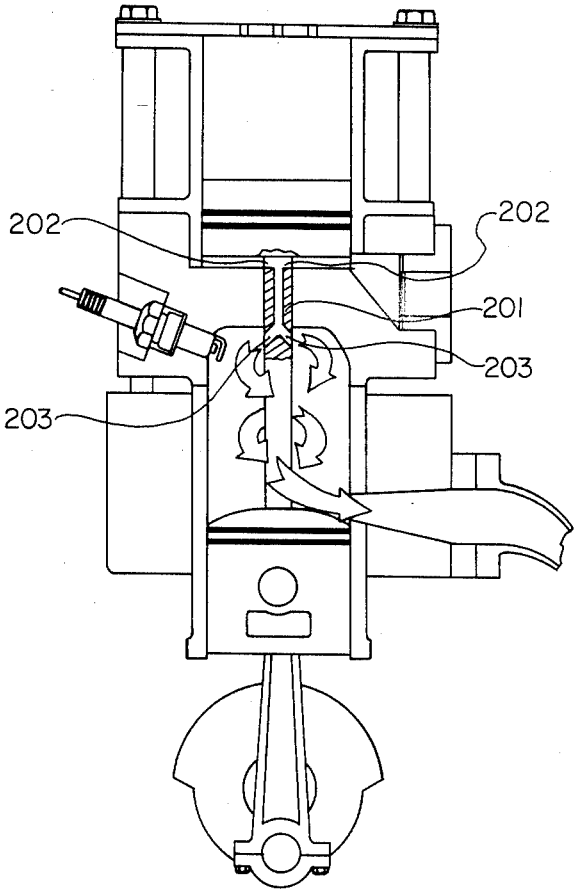

FIG. 5 shows it used as the liquid pump. The filter 501 is used for the filtration of the input fluids. The inlet valve 502 is connected with the filter and the inlet opening on the upper side of the pump chamber. The outlet valve 503 is connected with the parts betwwen the pump chamber and the fluid load. The pressurizing valve 504 is connected with the parts between the input side and the output side and forms a liquid pump function with the direct drive.

Figures 2, 3, 4, 5, 6:
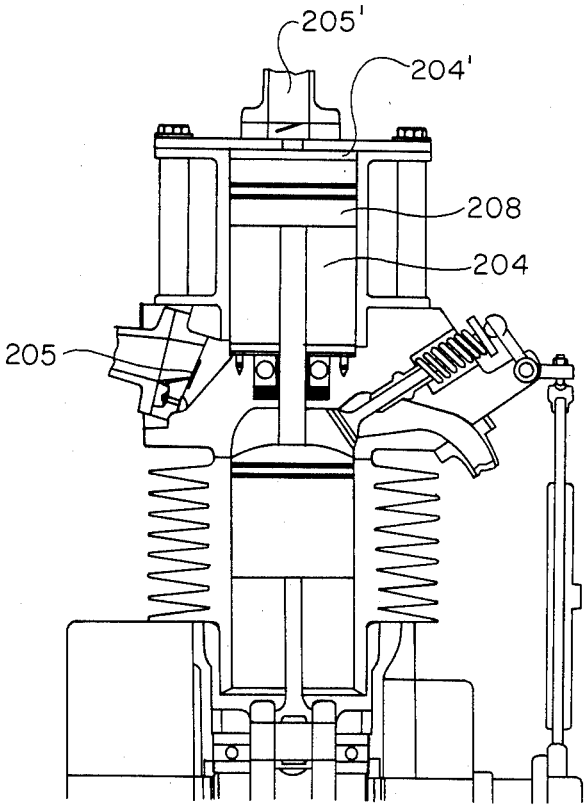

The another new application equipment of this design is defined in FIG. 6. A permanent magnetic pole 601 is equipped on the upper piston 108 in FIG. 1; or a magnetic pole 630 is magnetized by the current runs through the coil 602 and is connected with the power supply using the soft conducting wire 604; or the magnetization produced by the conduction of the current using a set of the carbon brush 605 and the conducting rod 606. When the piston is moving, the inductive voltage is generated due to the change of the magnetizing quantity between the magnetizing pole and the electrical coil 607 and thus it can supply electrical energy. Therefore, it becomes a lineal drive electric generating equipment.

For the structure application, the position of the abovementioned permanent magnetic pole and the electric generating winding can be reserved as shown in FIG. 6-1. The magnetic field is formed by the ring permanent magnet 601' or the ring coil 602', in which the movable parts are formed by the electric generating winding 607' and its electric energy is transmitted by the carbon brush 605' and the conducting rod 606' or the soft conducting wire 604'.

Figures 2, 3, 4, 5, 6, 7:
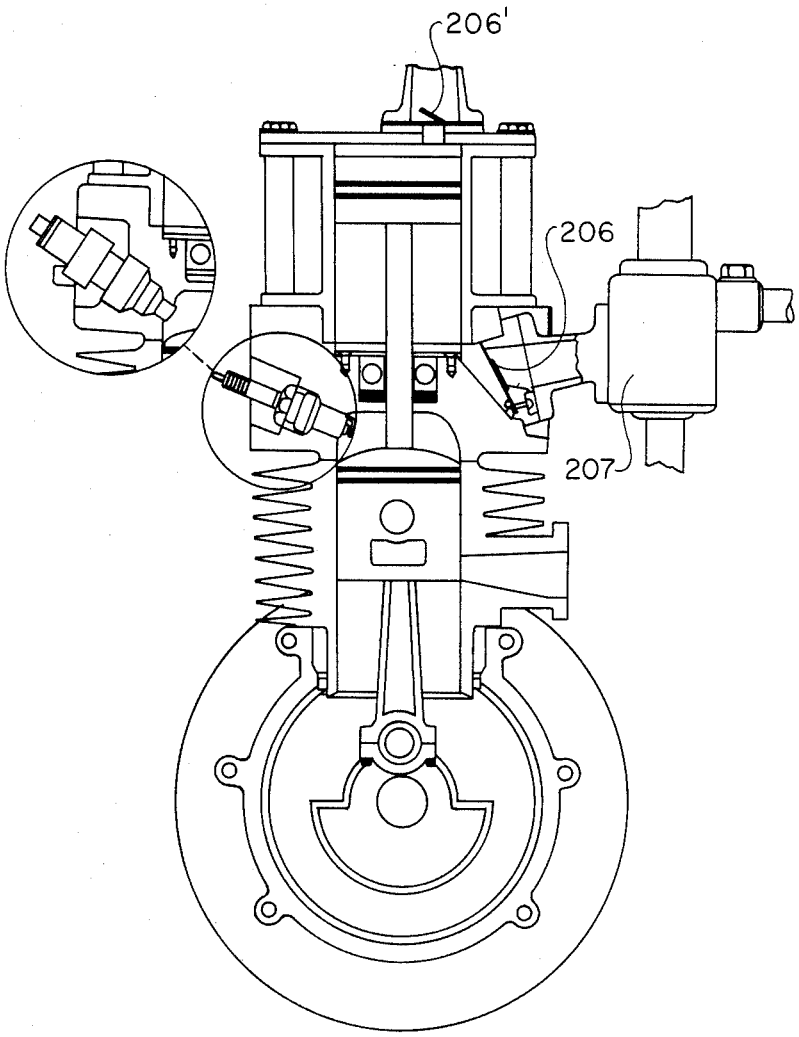
Figure 3:
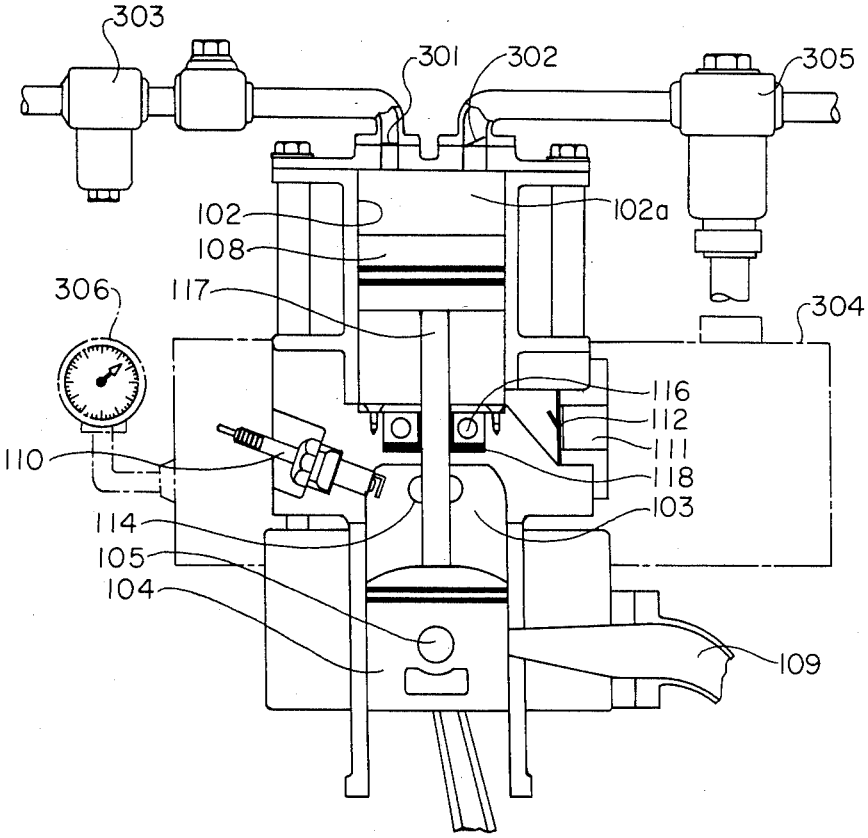
Figure 4:
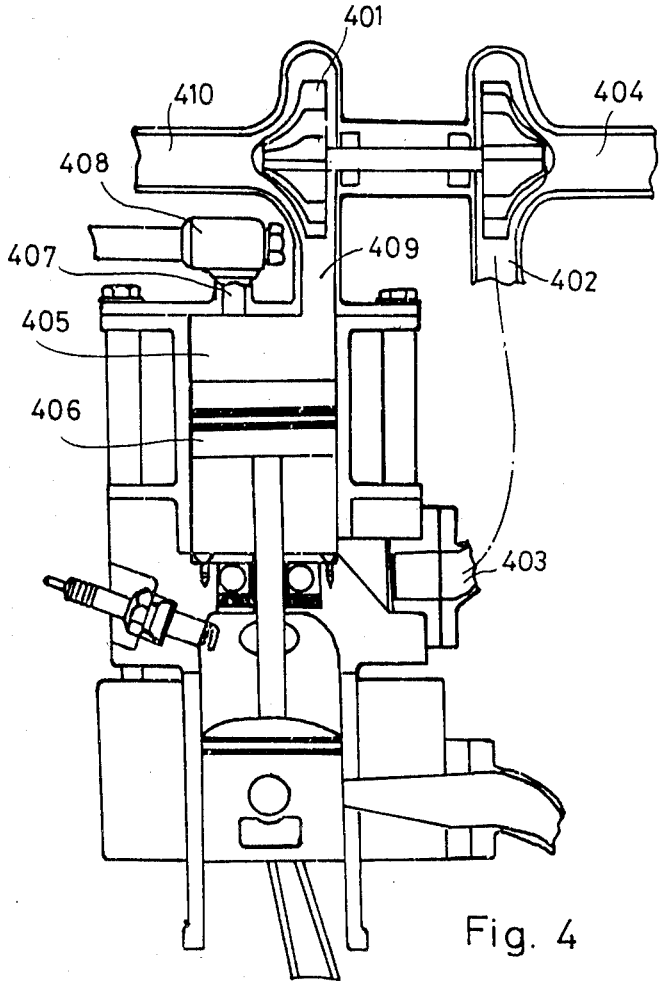
Figures 1, 4:
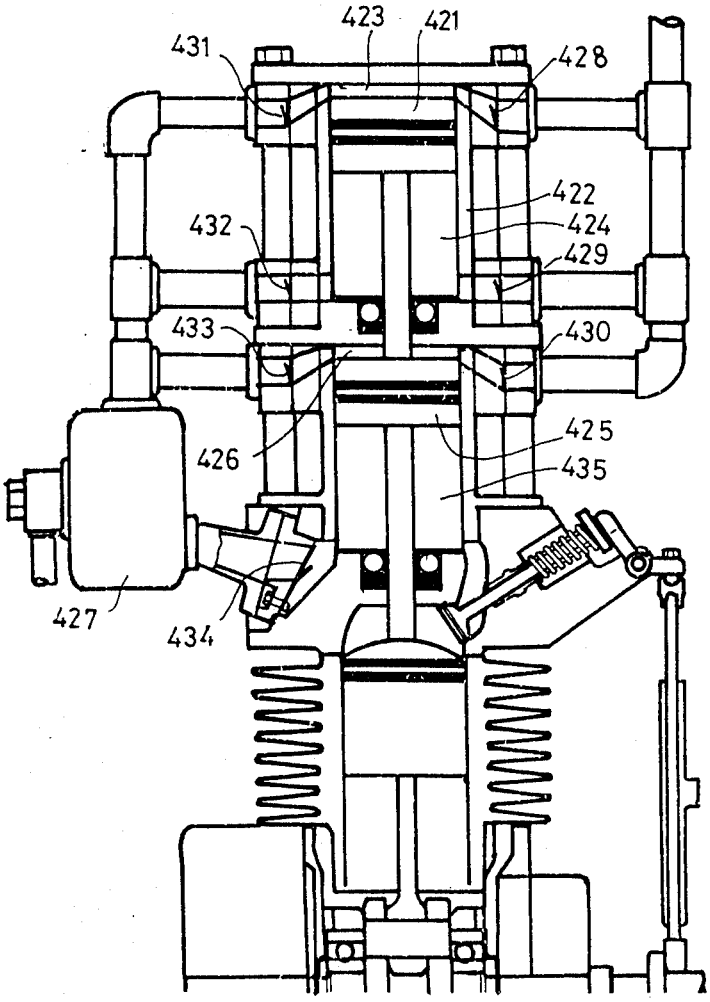
Figures 2, 4:
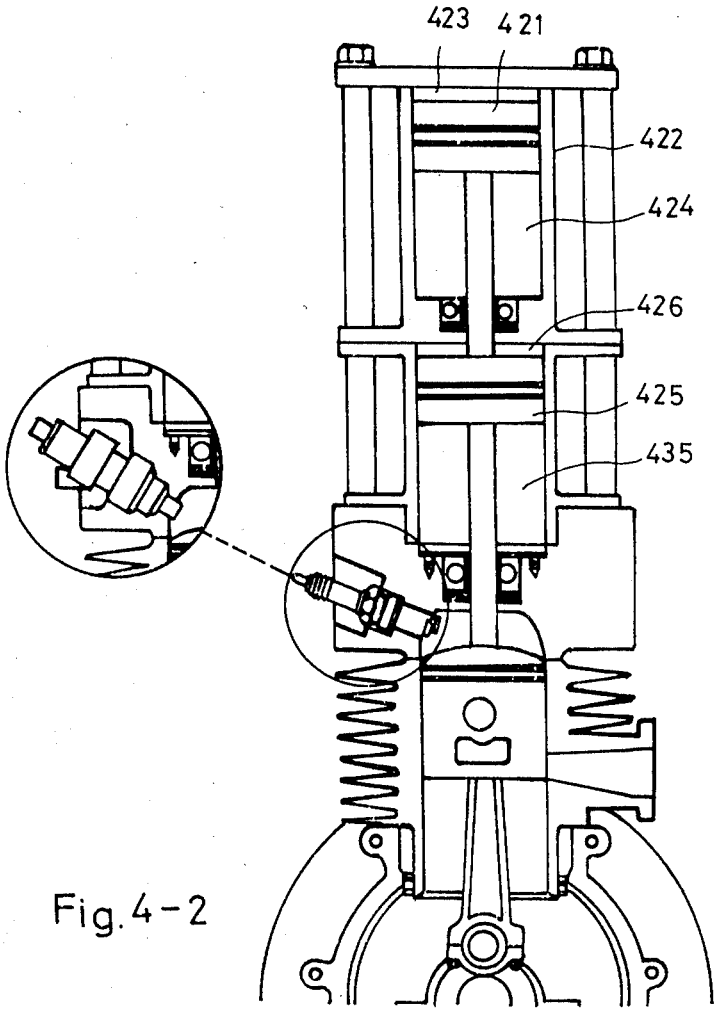
Figure 5:
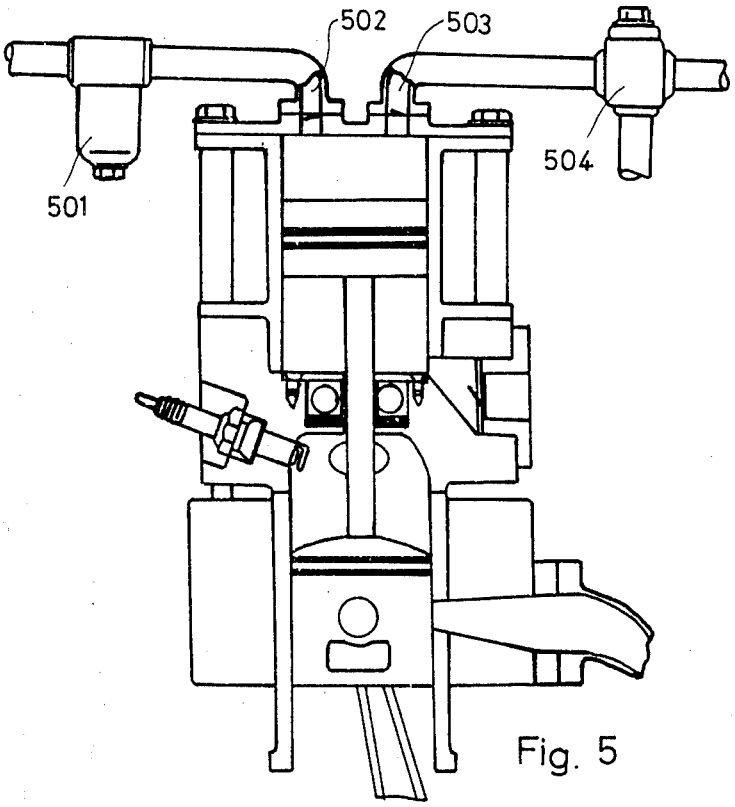
Figure 6:
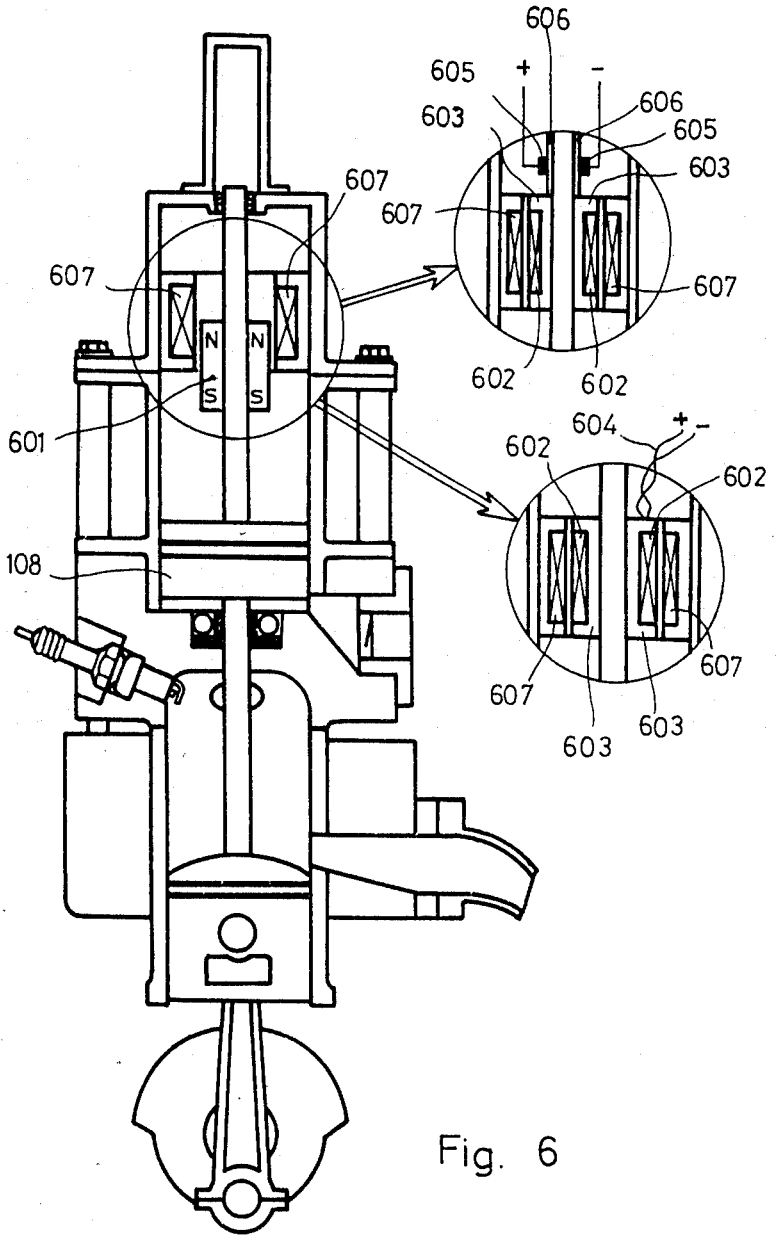
Figures 1, 6:
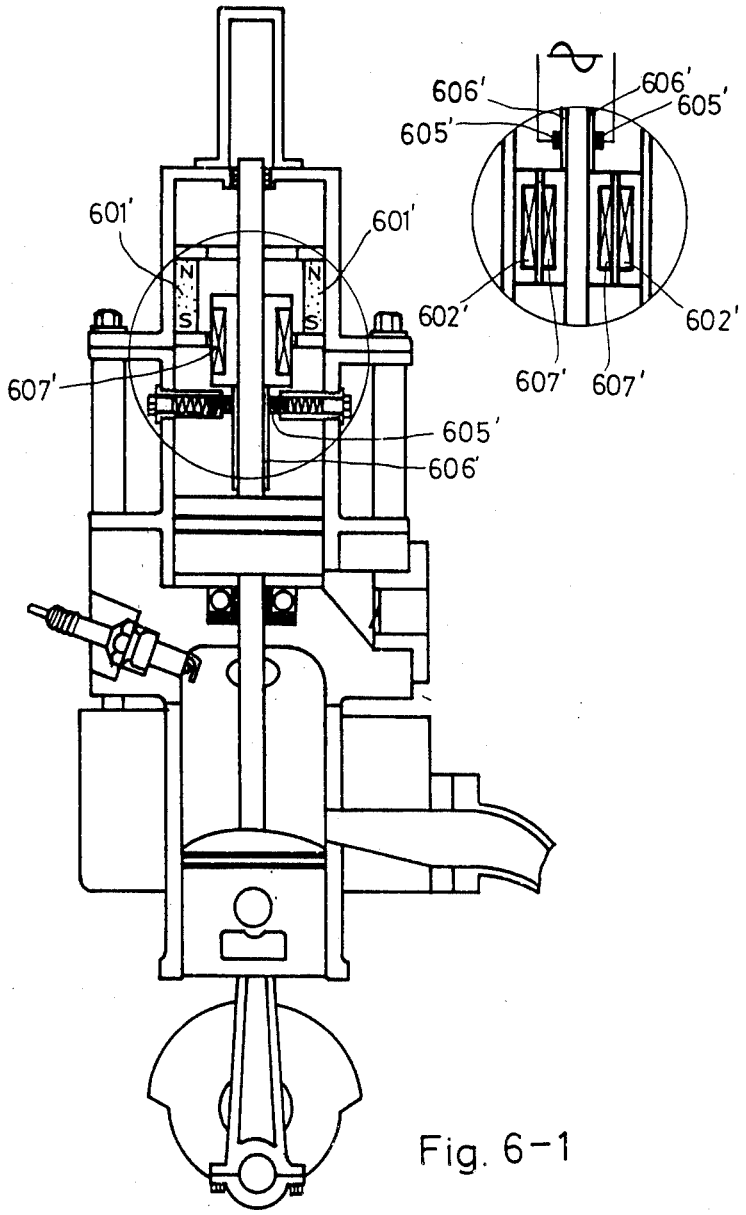
Figure 7:
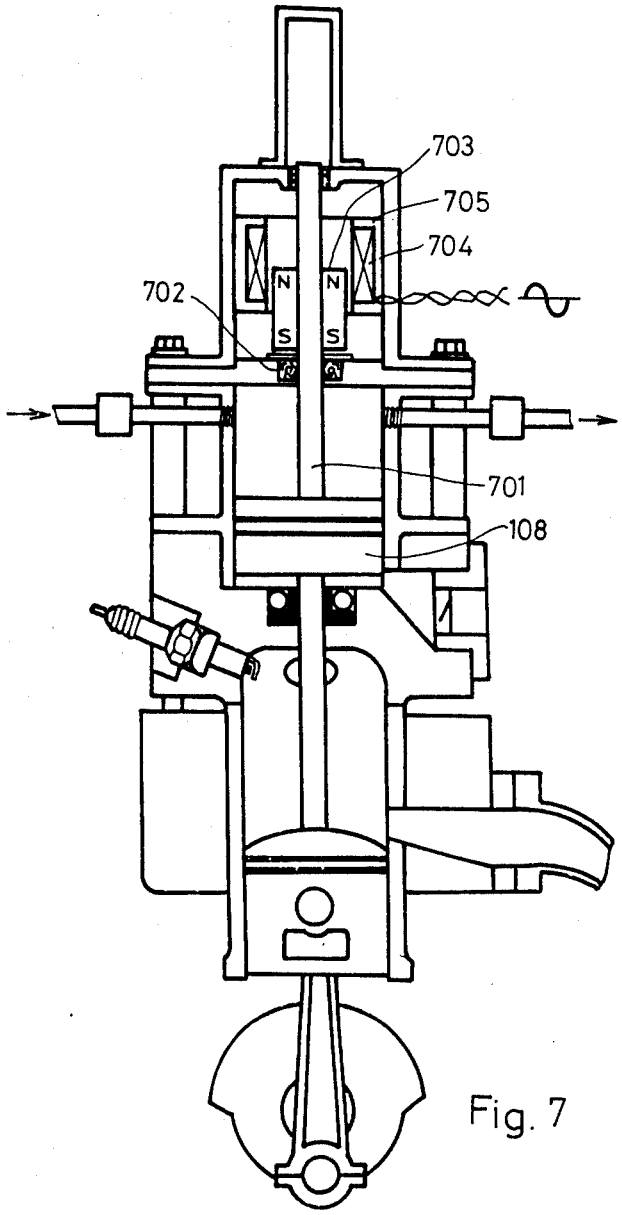

Furthermore, in the lineal drive electric generating equipment, the abovementioned electric generating equipment can be equipped on the upper side of the upper piston and is moved by a rod extended from the upper piston as shown in FIG. 7, in order to avoidance of the electric fenerating volume limited by the space of the pressurizing cylinder and in order to getting better power match of the engine power and the electric generating power; or in order to keeping the pump drive function of the piston on the pressurizing gas chamber. In FIG. 7, the upper link 701 is connected with the upper side of the upper piston 108. The gas seal cover 702 is used for the sealing of the upper gas chamber cover and the upper link 701. No. 701 is magnetizing pole; 704 is electric generating winding; 705 is magnetic circuit iron core. The selection of the structure design for the electric generation can be done as the abovementioned one, thus the magnetizing pole and the electric generating winding are equipped inversely and the electric energy is transmitted to the middle moving parts using the conducting rod and the carbon brush or the soft conducting wire. In this type of the design, the diameter and the relative dimensions can be selected for the power match in the electric generating equipment.

Figure 8:
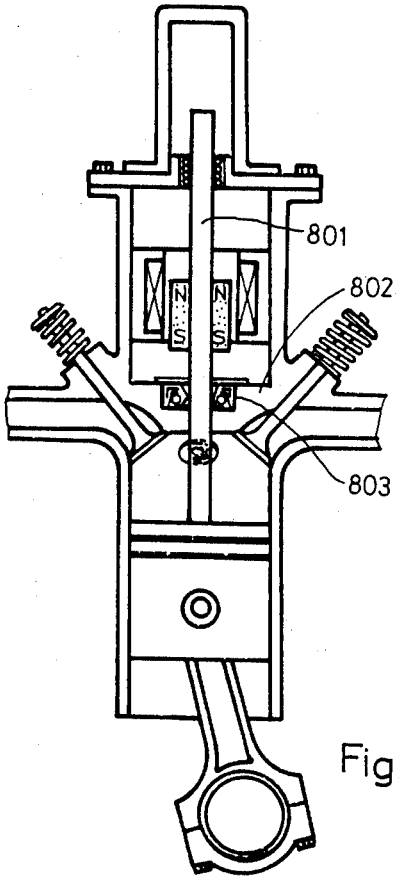
FIG. 8 shows the diagram of an application example of the lineal electric generation equipment coupled with the upper side of the traditional piston engine.

The abovementioned lineal drive electric generating equipment can be used for the traditional engine (See FIG. 8). Its structure character is same as the abovementioned example. The transmission rod 801 is equipped on the piston and the pierce through the cylinder cover 802. The gas seal cover 803 is used for the sealing of the lineal drive electric generating equipment coupled parts between the transmission rod 801 and the cylinder cover 802 and can move back and forth dependent on the moving of the piston, so that the electric energy can be generated.

In the various electric generation equipment of the abovementioned application examples of the electric generation, excepting the outer ring electric equipment has fixed structure and the middle electric equipment is linked with the piston, it can be done by the inverse direction, i.e. the outer ring electric equipment is dynamic acceptance piston and moves forth and back, the middle electric equipment is atastic one and acts as the input or the output type of the electric energy for the outer cycle structure. The work is performed by the abovementioned method, i.e. by the soft conducting wires or the conducting rods or the carbon brushes.

Figure 9:
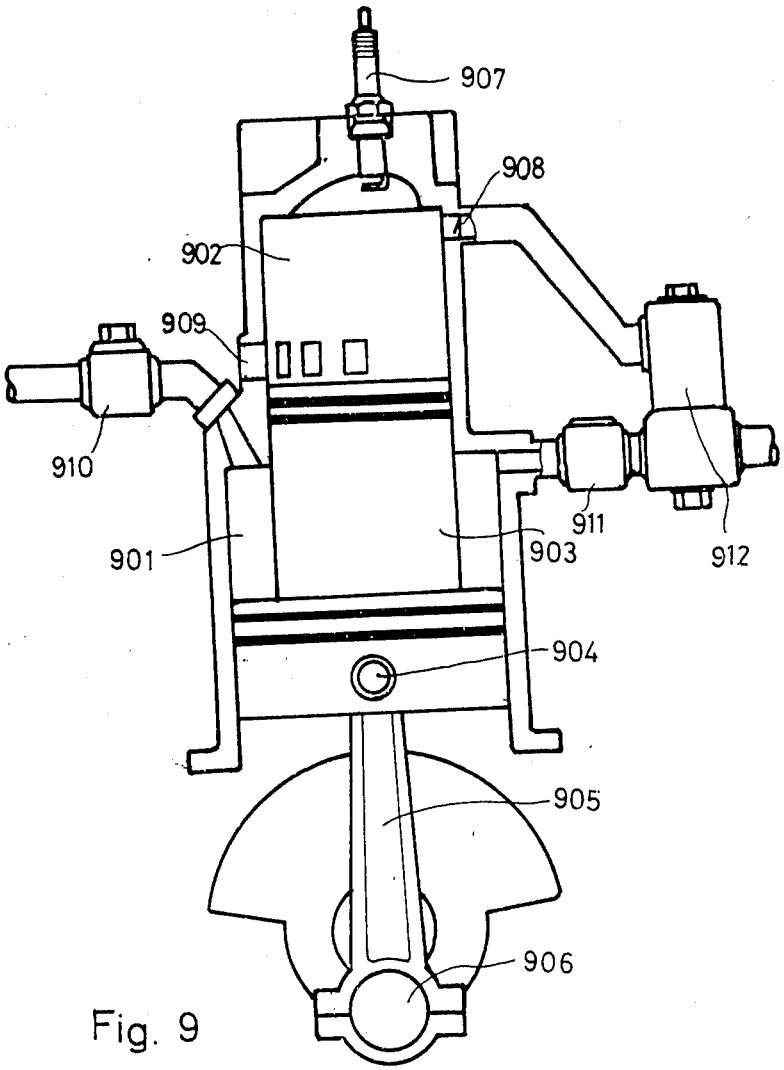
FIG. 9 shows the diagram of an application example of the separate gas chamber engine with the different cylinder diameters.
Figures 1, 9:
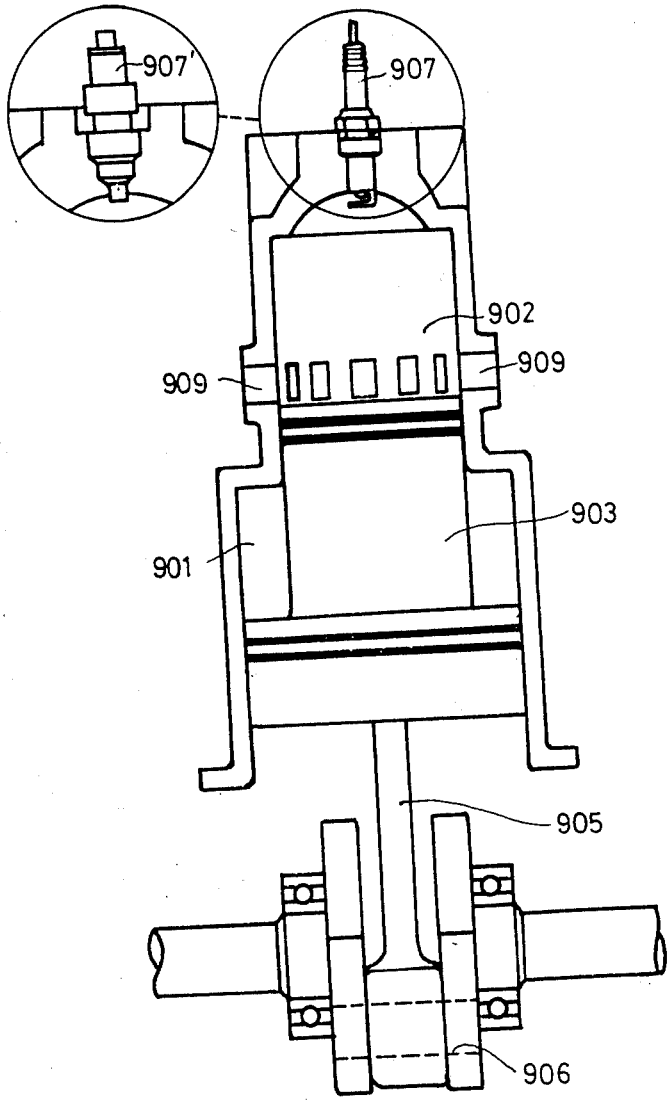

This engine uses practically the diameters of the upper gas chamber and its upper piston and the lower gas chamber and its lower piston and can select the diameter according to the requirement in order to arrangement of the size of the pressure input gas chamber and explosion gas chamber for the used selection. For example, we can select the larger pressure input gas chamber for the lower density air in the high open air. Furthermore, as defined in the FIGS. 9 and 9-1, the structure types of the separate gas chamber engine with the different cylinder diameters have the separate gas chambers with a larger and a small diameters respectively in the engine body. Its inner body has also a piston with the different diameter. This piston is connected separately with two gas chambers coupled respectively with two different diameters, in which a set one is explosion gas chamber 902 (the upper gas chamber in the diagram) and the another set is the pressure input gas chamber 901 (ring type lower gas chamber in the diagram). The piston 903 has a transverse lever link 904 for the connection of the shaking rod 955 and for the driving crank shaft 906. A ignition plug 907 or a fuel nozzole 927 and a single way intake door 908 connected with the pressure reservoir are equipped in the near of the upper stop point of the combustion gas chamber. A exhaust opening 909 is equipped in the near of the lower stop of the explosion gas chamber 902. A single way intake door 910 and a single way exhaust opening 911 connected with the pressure reservoir 912 are equipped in the near of the upper stop point gas chamber. After the engine has started, the combustion gases with the high pressure are stored in the pressure reservoir 912 for each work cycle due to the pressure input volume is larger than the explosion gas chamber. During the intake travel, the intake door is opened and the fresh airs come into the combustion chamber.

Figure 10:
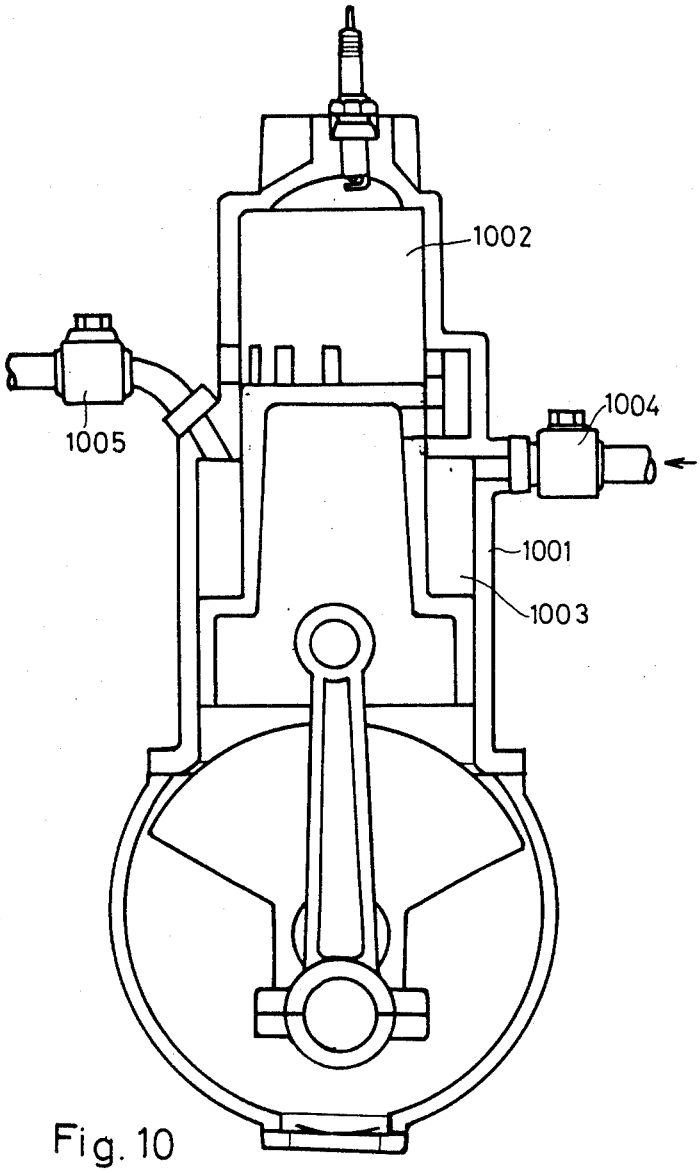
FIG. 10 shows the diagram of an application example of one piece of the two-travel pump with the different cylinder diameters.
Figures 1, 10:
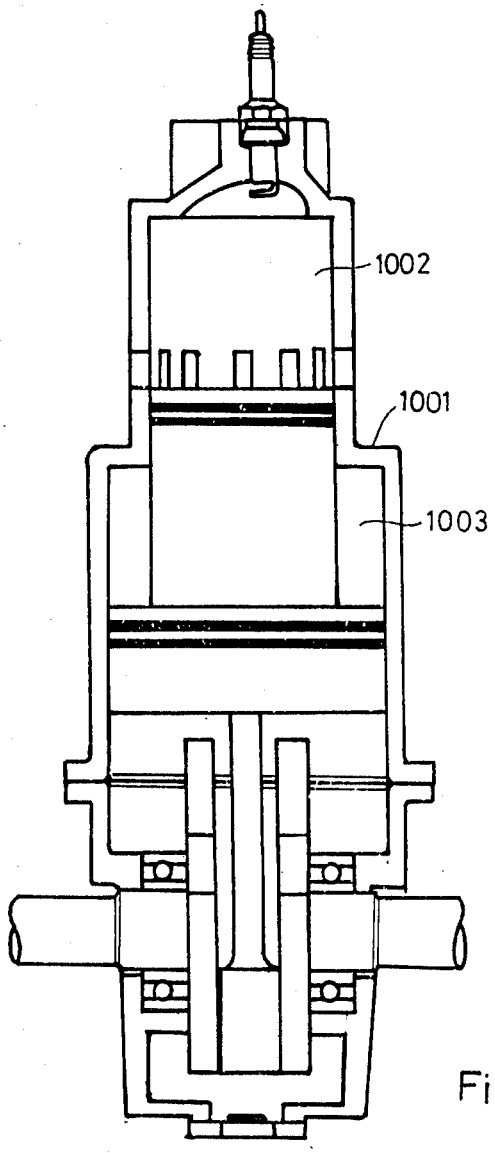

As to the lubrication, the lubricating oil can be distributed by the pump leaf blade equipped on the crank shaft to inside of the piston and then penestrated to the friction surfaces. If we use one unit type of the drive pump in the separate gas chamber with the different diameters, its structure character is same as which shown in FIGS. 10 and 10-1, i.e. it is a two travel engine with the direct coupling and independent pump structure. The engine housing 1001 has gas chambers with a large and a small diameters respectively, in which the upper gas chamber is two travel standard pressure input explosion gas chamber 1002 and the lower ring gas chamber with the larger diameter is pump chamber 1003 used for the fluid pump. In the near of the upper stop point, a inlet of a single way valve 1004 and a outlet of the another single way valve 1005 are equipped. They can generate the gas pump function in the engine drive. Because this engine has a larger volume of the lower piston, the pressure generated by the crank shaft case used for the intake pump of the two-travel engine during the running travel is larger than the traditional one and is more advantage for the intake.

Figure 11:
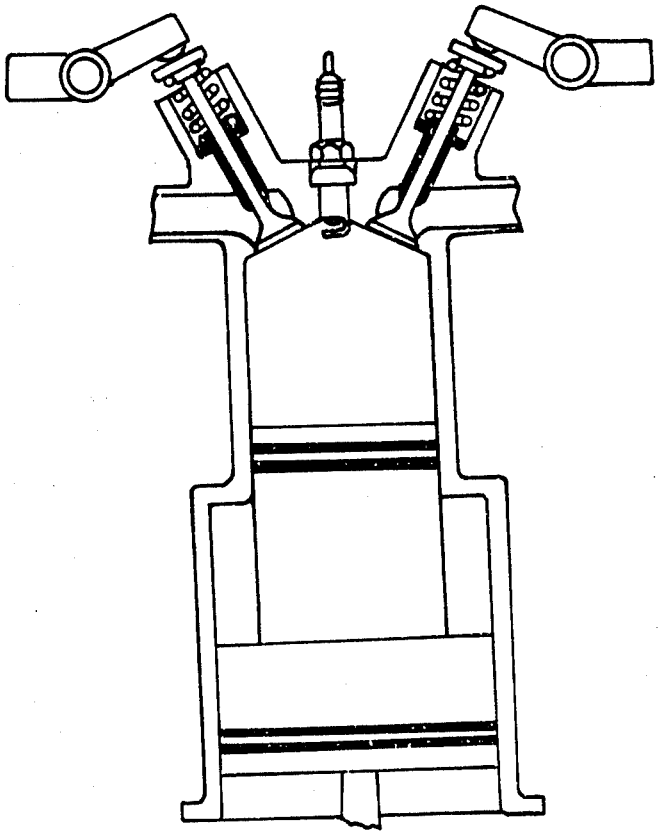
FIG. 11 shows the diagram of an application example of one piece of four-trvel pump with the different cylinder diameters.
Figures 1, 11:
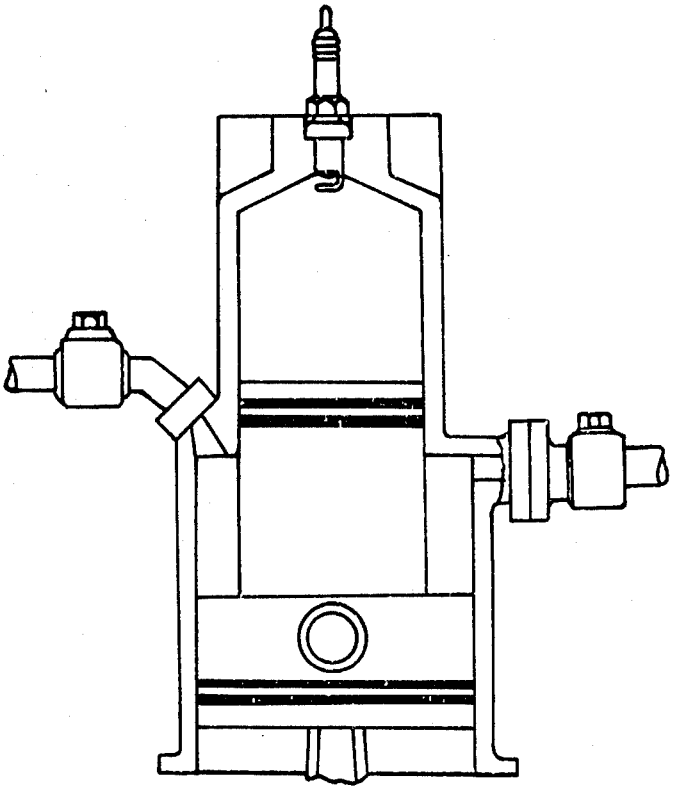

FIGS. 11 and 11-1 show the application example of the equipment in the four travel engine. Its structure character is same as which in the two travel one.

When the abovementioned an-unit type of the intake pressurizing, separate gas chamber structure and the industrial equipment is used for Diesel engine, the structure and the principle are same as the above-said one with the exception of the change of the ignition plug to jet oil nozzole and the increasment of the compression ratio.

I claim:

1. An internal combustion engine, comprising:

an engine block having an upper cylindrical gas chamber and a lower cylindrical gas chamber, a bottom portion of said upper gas chamber serving as a compression chamber for gases introduced into said lower gas chamber, said lower chamber serving as a combustion chamber;

a piston assembly comprised of a lower piston located in said lower gas chamber, an upper piston located in said upper gas chamber and dividing said upper chamber into two portions including a top upper chamber portion and the bottom upper chamber portion, and a shaft connecting said upper and lower pistons for moving both upper and lower pistons in phase with one another;

sealing means for permitting reciprocating movement of said connecting shaft within said upper and lower chambers and for providing a seal between said upper and lower chambers;

cooling means jacketing said sealing means for cooling said sealing means, upper chamber intake means for allowing gas to be introduced into said bottom portion of said upper gas chamber;

upper chamber intake valve means for preventing gas from exiting from said bottom portion of said upper gas chamber through said upper chamber intake means;

an inter-chamber passageway in said engine block for permitting flow of gas from said bottom portion of said upper chamber directly to said lower chamber;

automatically controlled lower chamber intake valve means for controlling flow of gas from said inter-chamber passageway to said lower chamber;

lower chamber exit means for permitting the contents of said lower gas chamber to be discharged from said chamber;

one-way fluid inflow means communicating with said top portion of said upper chamber, and permitting a fluid to be drawn into said top portion of said upper chamber when said upper piston moves away from said upper chamber;

one-way fluid outflow means communicating with said top portion of said upper chamber, and permitting a fluid to be pumped out of said top portion of said upper chamber when said upper piston moves toward said upper chamber;

a fuel source for providing fuel to said lower chamber, wherein the fuel from the fuel source passes in sequence through said upper chamber intake means, said lower portion of said upper chamber, said inter-chamber passageway in said engine block, and said automatically operated lower chamber intake valve means prior to entry into said lower chamber; and ignition means for igniting the gaseous contents of said lower chamber, said ignition means automatically periodically being energized and unenergized in coordination with the automatic operation of said automatically controlled lower chamber intake valve means.

2. The internal combustion engine described in claim 1, wherein the fuel from the fuel source is mixed with air to form a fuel and air mixture prior to entry into said lower chamber.

3. The internal combustion engine described in claim 1, wherein the fuel from the fuel source is injected directly into said lower chamber.

4. The internal combustion engine and fluid pump described in claim 1, further comprising a reservoir for receiving the pumped fluid.

5. The internal combustion engine and fluid pump described in claim 1, wherein said fluid is air.

6. The internal combustion engine and fluid pump described in claim 1, wherein said fluid is a liquid.

7. A pumping apparatus driven by an internal combustion engine as described in claim 1, said pumping apparatus comprising:

a material source for supplying the material to be pumped;

a pumping chamber for receiving the material;

a pump piston located within said pumping chamber and dividing said pumping chamber in a top pumping chamber portion and a bottom pumping chamber portion;

shaft means connected to said pump piston and extending through said bottom pumping chamber portion to a reciprocating piston in the internal combustion engine;

sealing means for permitting reciprocating movement of said connecting shaft within said pumping chamber and the internal combustion engine, and for providing a seal between said pumping chamber and the internal combustion engine;

one-way material intake means communicating with said top portion of said pumping chamber and permitting the material to be drawn into said top portion of said pumping chamber when said pump piston moves toward the internal combustion engine; and one-way material exit means communicating with said top portion of said pumping chamber and permitting the material to be pumped out of said top portion of said pumping chamber when said pumping piston moves away from the internal combustion engine.

8. The pumping apparatus described in claim 7, further comprising:

a filter for filtering the material to be pumped before it enters said pumping;

a pressure reduction valve for reducing the pressure of the pumped material after it exits said pumping chamber; and a reservoir for receiving pressurized material coming from said pumping chamber.

* * * * *